US005242269A

United States Patent [19]

Chang

[11] Patent Number: 5,242,269

[45] Date of Patent: Sep. 7, 1993

[54] MOUNTING DEVICE FOR A CEILING FAN

[76] Inventor: Baosen Chang, No. 67, San Feng Rd., Hou Li Hsiang, Taichung Hsien, Taiwan

[21] Appl. No.: 997,680

[22] Filed: Dec. 28, 1992

[51] Int. Cl.[5] ..... F04D 29/00

[52] U.S. Cl. ..... 416/244; 416/5; 248/343; 362/405

[58] Field of Search ..... 416/5, 244 R, 170 C; 248/342, 343, 344; 362/404, 405, 406, 147, 96

[56] References Cited

U.S. PATENT DOCUMENTS 1,940,318 12/1933 Morse ..... 416/5
2,937,841 5/1960 Bodian ..... 362/404
4,878,806 11/1989 Markwardt ..... 416/5

FOREIGN PATENT DOCUMENTS 2149013 6/1985 United Kingdom ..... 416/5

*Primary Examiner*—Edward K. Look
*Assistant Examiner*—James A. Larson
*Attorney, Agent, or Firm*—Peterson, Wicks, Nemer & Kamrath

[57] ABSTRACT

A mounting device for a ceiling fan includes a plate having a protrusion formed in a middle portion and having a pair of flanges oppositely formed beside the protrusion, a notch formed between the protrusion and each of the flanges, a panel including a pair of flaps engaged through the notches of the plate and arranged such that the flaps are located above and supported by the flanges, and a pad engaged between each of the flaps and the respective flanges of the plate. The panel can thus be solidly coupled to the plate.

5 Claims, 3 Drawing Sheets

MOUNTING DEVICE FOR A CEILING FAN

BACKGROUND OF THE INVENTION

1. Field of the Invention

The present invention relates to a mounting device, and more particularly to a mounting device for a ceiling fan.

2. Description of the Prior Art

A typical mounting device for mounting a ceiling fan to the ceiling is shown in FIG. 4 and comprises a plate 1 including a plurality of holes 12, 13 formed therein, a screw 4 engaged in each of the holes 13 and fixed to the plate 1 by welding processes, a hook 5 engaged in one of the holes 13 and fixed to the plate 1 by welding processes, a protrusion 10 formed in the middle portion of the plate 1 and protruded upward, an opening 11 formed in the center of the protrusion 10. The plate 1 can be attached to the ceiling by screws (not shown) which engage through the other holes 12. A panel 2 includes an orifice 22 formed in the middle portion and four notches 21 formed in the end portions for engagement with the screws 4, a pad 3, a washer 31 and a nut 41 are engaged on each of the screws 4 for fixing the panel 2 to the plate 1.

However, in such a mounting device, the screws 4 and the hook 5 should be welded to the plate 1, this complicates the manufacturing processes of the mounting device. The pads 3 and the washers 31 can not be easily engaged on the screws 4 when the screws 4 are not welded in good shape, i.e., the screws 4 are not exactly perpendicular to the plate 1. The pads 3 can not be easily engaged in the notches 21 of the panel 2. In addition, the whole ceiling fan should be supported by the user when threading the nuts 41. Furthermore, the whole ceiling fan is supported by the four nuts 41, such that the ceiling fan is apt to fall down when the nuts 41 have become loose.

The present invention has arisen to mitigate and/or obviate the afore-described disadvantages of the conventional mounting devices for ceiling fans.

SUMMARY OF THE INVENTION

The primary objective of the present invention is to provide a mounting device for solidly attaching the ceiling fan to the ceiling.

In accordance with one aspect of the invention, there is provided a mounting device for a ceiling fan comprising a plate including a protrusion formed in a middle portion thereof and a pair of flanges oppositely formed beside the protrusion, a notch formed between the protrusion and each of the flanges, a panel including a pair of flaps oppositely formed thereon and engaged through the notches of the plate and arranged such that the flaps are located above and supported by the flanges respectively, and a pad engaged between each of the flaps and the respective flanges of the plate, whereby, the panel is solidly coupled to the plate.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
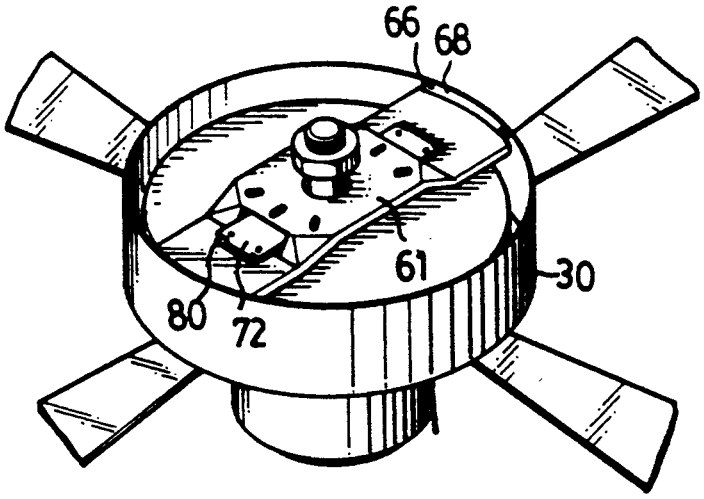
FIG. 1 is a perspective view of a mounting device for a ceiling fan in accordance with the present invention.
Figure 3:
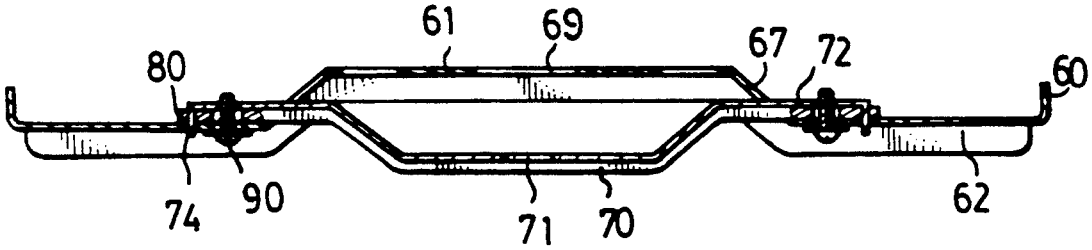
FIG. 3 is a cross sectional view of the mounting device.
Figure 2:
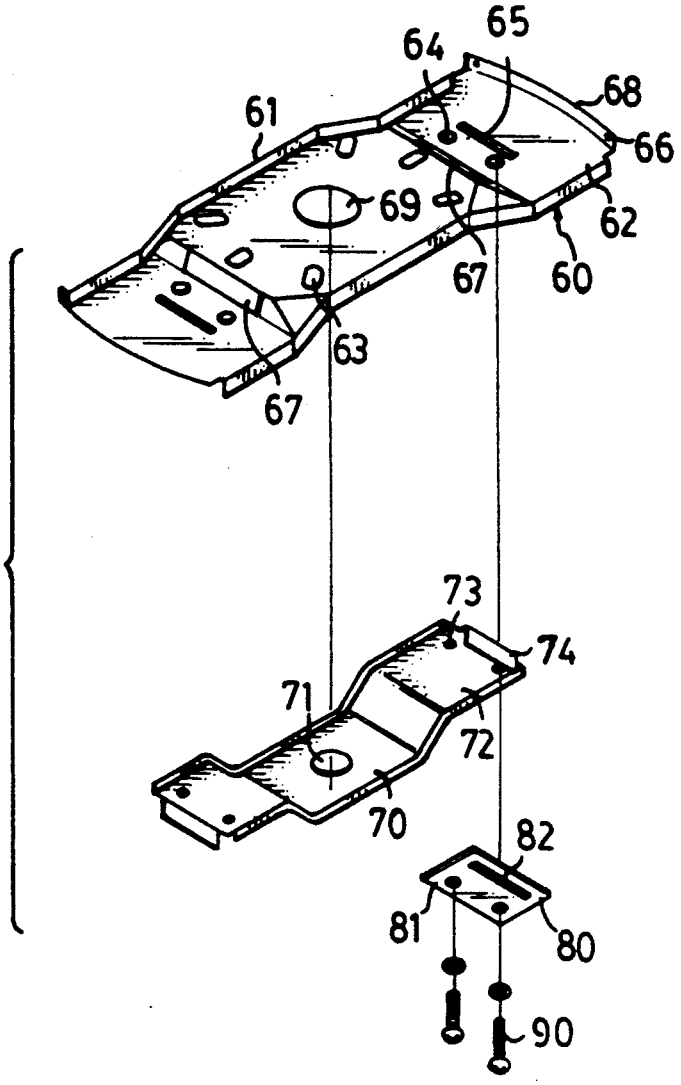
FIG. 2 is an exploded view of the mounting device.
Figure 4:
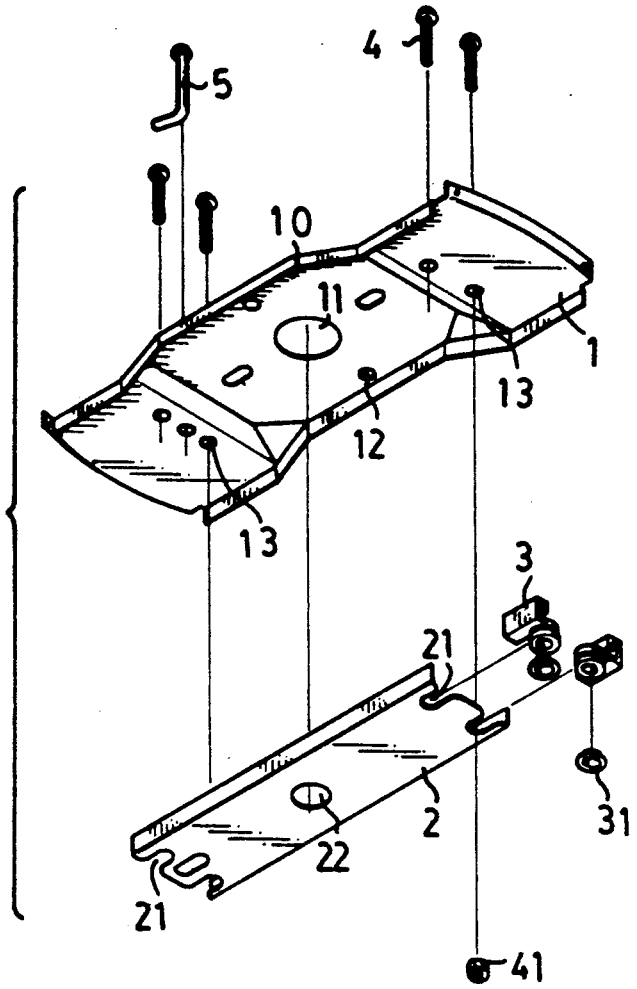
FIG. 4 PRIOR ART
FIG. 4 is an exploded view of the typical mounting device.

Referring to FIGS. 1 to 3, a mounting device for fixing a ceiling fan 30 to the ceiling in accordance with the present invention comprises a plate 60 including an opening 69 formed in the center thereof, the plate 60 includes a protrusion 61 protruded upward from the middle portion thereof and a pair of flanges 62 oppositely formed beside the protrusion 61, a plurality of holes 63 are formed in the protrusion 61, screws (not shown) may be engaged through the holes 63 for fixing the plate 60 to the ceiling, two apertures 64 and a slot 65 are formed in each of the flanges 62, an ear 68 is formed in the free end portion of each of the flanges 62 and includes two punctures 66 formed therein for fixing to the ceiling fan 30, and a notch 67 is formed between the protrusion 61 and each of the flanges 62.

A panel 70 includes an orifice 71 formed in the center portion thereof and includes two flaps 72 formed thereon, each of the flaps 72 includes two screw holes 73 formed therein, and a tab 74 is depended downward from the free end portion of each of the flaps 72, the flaps 72 are engaged through the respective notches 67 of the plate 60 such that the flaps 72 are located above the respective flanges 62, and the screw holes 73 of the flaps 72 are aligned with the apertures 64 of the plate 60. As best shown in FIG. 3, a pad 80 is engaged between each of the flaps 72 and the respective flanges 62 of the plate, each of the pads 80 includes two orifices 81 aligned with the apertures 64 of the plate 60 and aligned with the screw holes 73 of the flaps 72, and includes a groove 82 formed therein and aligned with the slot 65 of the respective flanges 62. The tabs 74 are engaged through the respective grooves 82 of the pads 80 and the slots 65 of the flanges 62 such that the panel 70 can be secured to the plate 60; in addition, a screw 90 is engaged through each of the apertures 64 and the respective orifices 81 and threadedly engaged with the screw holes 73 of the panel 70 such that the panel 70 can further be secured to the plate 60.

Accordingly, the mounting device in accordance with the present invention includes a pair of pads 80 which can be easily engaged between the flanges 62 of the plate 60 and the respective flaps 72 of the panel 70, and the panel 70 can be solidly secured to the plate 60. In addition, the flaps 72 of the panel 70 are supported on the flanges 62 of the plate 60 such that the panel 70 will not be disengaged from the plate 60 and such that the ceiling fan can be stably supported in place.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A mounting device for a ceiling fan comprising a plate including a protrusion formed in a middle portion thereof and a pair of flanges oppositely formed beside said protrusion, a notch formed between said protrusion and each of said flanges, a panel including a pair of flaps oppositely formed thereon and engaged through said notches of said plate and arranged such that said flaps are located above and supported by said flanges respectively, and a pad engaged between each of said flaps and the respective flanges of said plate, whereby, said panel is solidly coupled to said plate.

2. A mounting device according to claim 1, wherein each of said flanges includes a slot formed therein, each of said pads includes a groove formed therein and aligned with said slot of the respective flanges, and each of said flaps of said panel includes a tab depended downward therefrom and engaged through the respective slots of said flanges and the respective grooves of said pads, whereby, said panel is further solidly coupled to said plate.

3. A mounting device according to claim 1 further comprising means for securing said flanges of said plate and said flaps of said panel and said pads together.

4. A mounting device according to claim 3, wherein said securing means includes at least one screw for solidly securing said flanges of said plate and said flaps of said panel and said pads together.

5. A mounting device according to claim 1, wherein each of said flanges of said plate includes an ear formed thereon for fixing to said ceiling fan.

* * * * *